US006055760A

United States Patent [19]

Cuson et al.

[11] Patent Number: 6,055,760

[45] Date of Patent: May 2, 2000

[54] FOREND FOR MINIMIZING RECOIL FROM A GUN

[76] Inventors: James N. Cuson, 101 Hawthorne Rd., Fulton, N.Y. 13069-4525; Bruce G. Butler, 2393 Edwards Rd., Waterloo, N.Y. 13165

[21] Appl. No.: 09/054,739

[22] Filed: Apr. 3, 1998

[51] Int. Cl.[7] ..... F41C 23/16

[52] U.S. Cl. ..... 42/74; 89/1.42; 42/71.01

[58] Field of Search ..... 42/74, 71.01, 71.02, 42/72, 73; 89/1.42

[56] References Cited

U.S. PATENT DOCUMENTS

| | | | |
|---|---|---|---|
| 2,104,129 | 8/1938 | Kress | 42/71.01 |
| 2,826,848 | 3/1958 | Davies | 42/71.011 |
| 3,023,527 | 3/1962 | Leek et al. | 42/71.01 |
| 3,444,778 | 5/1969 | Bates | 42/71.01 |
| 3,543,428 | 12/1970 | Bronson | 42/71.01 |
| 4,228,633 | 10/1980 | Pachmayr et al. | 42/74 |
| 4,502,238 | 3/1985 | Farrar et al. | 42/72 |
| 4,536,982 | 8/1985 | Bredbury | 42/71 |
| 4,759,145 | 7/1988 | Volansky | 42/71.01 |
| 5,027,542 | 7/1991 | Simonetti | 42/72 |
| 5,048,215 | 9/1991 | Davis | 42/72 |
| 5,417,002 | 5/1995 | Guerra | 42/72 |

*Primary Examiner*—Michael J. Carone
*Assistant Examiner*—Denise J Buckley
*Attorney, Agent, or Firm*—Howard J. Greenwald

[57] ABSTRACT

A forend assembly with a pistol grip assembly which contains a pistol grip and a slide assembly attached to the pistol grip. One portion of the slide assembly is secured to the rear of the forend assembly; and another portion of the slide assembly is resiliently attached to the first portion so that its movement is somewhat restricted. The entire slide asssembly is disposed within a slot located on the underside of the forend.

18 Claims, 3 Drawing Sheets

FOREND FOR MINIMIZING RECOIL FROM A GUN

FIELD OF THE INVENTION

A forend assembly for minimizing the recoil experienced when a gun is fired.

BACKGROUND OF THE INVENTION

A forend is the front part of a gun, which supports the barrel. Certain pistols and other guns have the forend at the underside of the barrel of the gun, and the forend may under some circumstances be held by a user's hand during firing or otherwise be contacted to support and aim the gun. These forend elements are normally formed of wood, and they may be secured to the barrel by a fastener or fasteners extending upwardly through the forend and connecting threadedly into a socket or sockets formed at the underside of the barrel. The upper portion of the forend may be shaped to contact and fit a lower portion of the barrel.

Forends are well known to the art and are described in, e.g., U.S. Pat. Nos. 5,711,102, 5,634,289, 5,605,002, 5,596, 830, 5,417,002, 5,225,611, 4,602,450, 5,502,238, 4,328,633, and the like. The entire disclosure of each of these United States patents is hereby incorporated by reference into this specification.

When a gun is fired, the laws of inertia dictate that there will be a recoil force; for every action, there is an equal and opposite reaction.

The recoil force present on firing large caliber or high pressure cartridges is often substantial, often exceeding 50 foot pounds. This recoil force can injure a shooters' hand.

Additionally, it often can cause the shooter to move the gun away from its intended target.

Attempts have been made to minimize and/or cushion this recoil. Thus, by way of illustration, U.S. Pat. No. 4,956,932 of Cupp describes a gun recoil pad which can be attached to the butt of a long gun. Thus, e.g., U.S. Pat. No. 4,774,873 describes a hydraulic cushioning system which utilizes a gas-filled cylinder to cushion the recoil force.

It is an object of this invention to provide a forend assembly which is relatively simple, inexpensive, and effective.

SUMMARY OF THE INVENTION

In accordance with this invention, there is provided a forend assembly comprising a pistol grip assembly which contains a pistol grip and a slide assembly attached to the pistol grip. One portion of the slide assembly is secured to the rear of the forend assembly; and another portion of the slide assembly is resiliently attached to the first portion so that its movement is somewhat restricted. The entire slide asssembly is disposed within a slot located on the underside of the forend.

BRIEF DESCRIPTION OF THE DRAWINGS

The invention will be described by reference to the specification, to the claims, and to the enclosed drawings in which like reference numerals refer to like elements, and in which:

DESCRIPTION OF THE PREFERRED EMBODIMENTS

Figure 1:
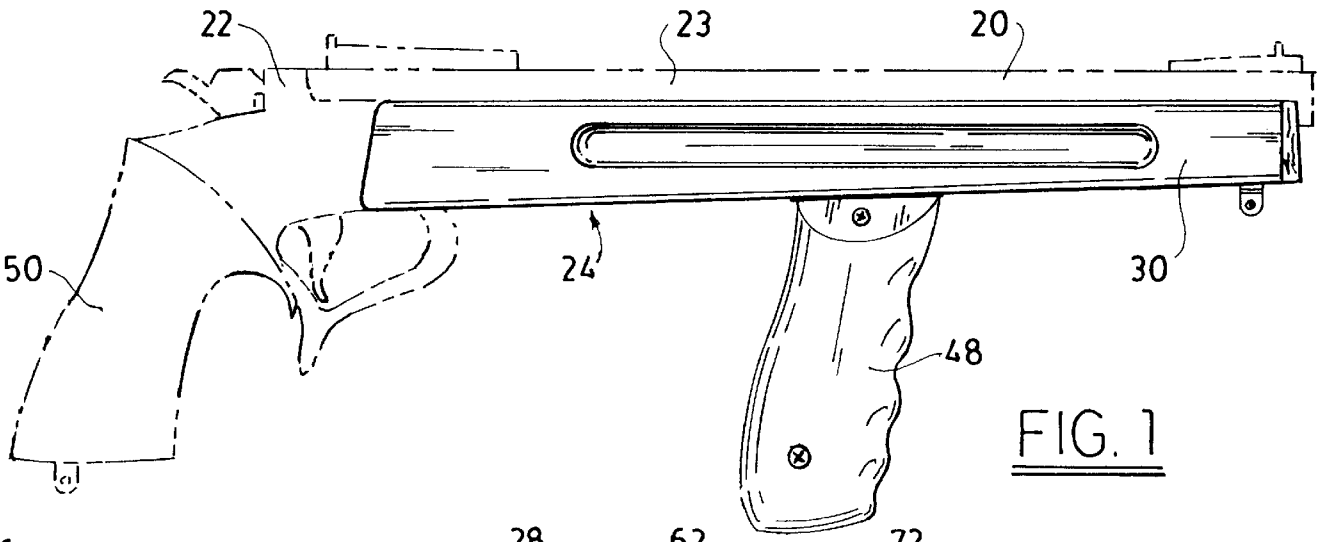
FIG. 1 is a partial side view of a gun assembly, illustrating one preferred embodiment of the forend of this invention.

FIG. 1 is a partial side view of a gun assembly 10 which is comprised of firearm frame 22, firearm barrel 23 and forend assembly 24.

Firearm frames are well known to those skilled in the art and are described, e.g., in U.S. Pat. Nos. 5,5812,046, 5,493, 806, 5,483,766, 5,425,300, 5,402,593, and the like. The entire disclosure of each of these United States patents Applications is hereby incorporated by reference into this specification.

In one preferred embodiment, the firearm frame is a "Thompson/Center Contender" firearm frame which is manufactured by the Thompson/Center Arms Company, Inc. of Rochester, N.H. and is described in such company's "CATALOG 23" (published in 1996). In another preferred embodiment, the firemarm frame i s a "Thompson/Center Encore" firearm frame which is manufactured by the same company.

Referring again to FIG. 1, firearm frame 22 is removably attached to firearm barrel 23.

Firearm barrels are well known to those skilled in the art and are described, e.g., in U.S. Pat. Nos. 5,579,923, 5,479, 737, 5,446,535, 5,443,543, 5,377,438, and the like. The entire disclosure of each of these United States patents is hereby incorporated by reference into this specification.

By way of further illustration, firearm barrel 23 may be one or more of the 12 inch hunter barrel, the super 14 barrel, the super 16 barrel, or the carbine barrel described in such "CATALOG 23" of the Thomp son/Center Arms Co., Inc. In general, it is preferred that barrel 23 have a length of at least about 12 inches.

Referring again to FIG. 1, it will be seen that barrel 23 is connected to forend assembly 24. One preferred means for removably connecting barrel 23 to forend assembly 24 is by means of socket head screws 26 and 28 (see FIG. 2) which extend through to the barrel 23 (which has been omitted from FIG. 2 for the sake of simplicity of representation).

Figure 2:
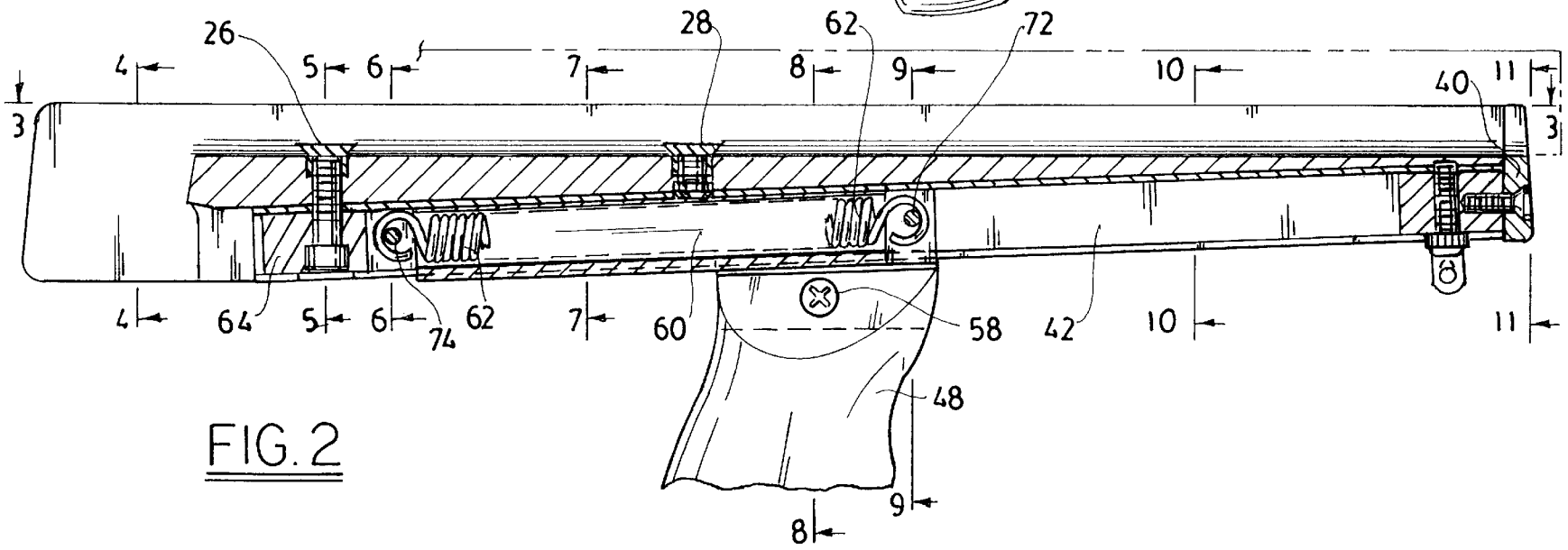
FIG. 2 is a sectional view of the forend assembly of FIG. 1.
Figure 3:
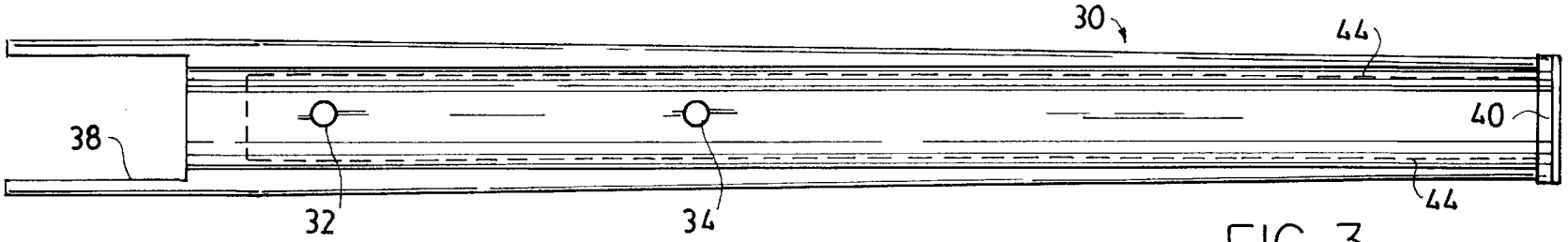
FIG. 3 is a top view of the forend assembly of FIG. 2.

FIG. 3 is a top view of forend 30. Referring to FIG. 3, it will be seen that forend 30 is comprised of orifices 32 and 34 through which appropriate fasteners (not shown in FIG. 3, but see FIG. 2) may be inserted to attach the barrel 23 (not shown in FIG. 3, but see FIG. 1) to the forend.

The forend preferably is made from wood; however, it may be from natural rubber, synthetic elastomeric material, and the like. Reference made be had, e.g., to U.S. Pat. No. 4,502,238, the entire disclosure of which is hereby incorporated by reference into this specification.

Figure 4:
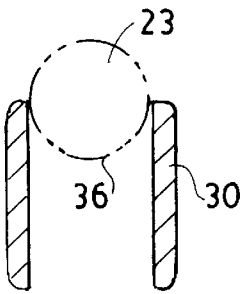
Figure 9:
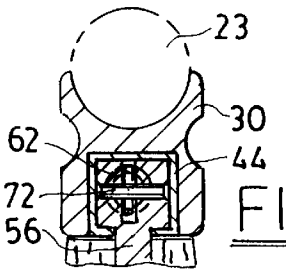
Figure 12:
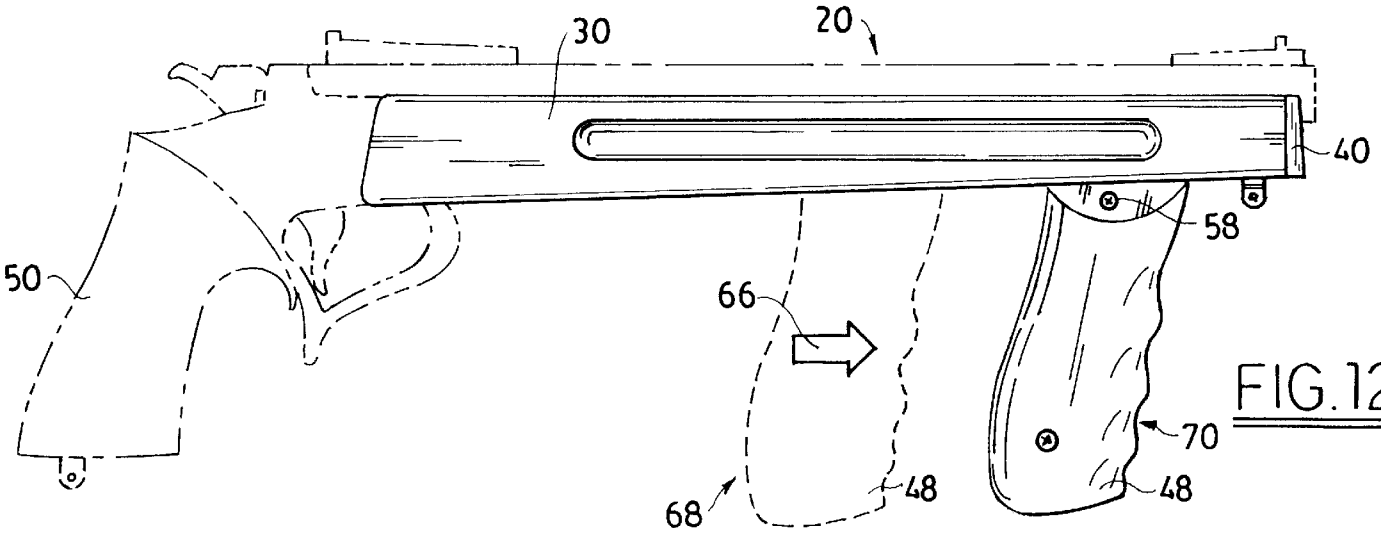
FIG. 12 is a schematic view illustrating how the pistol grip moves forward upon experiencing the recoil force of firing.

Referring to FIG. 4, it will be seen that forend 30 is comprised of a recess 36 adapted to receive barrel 23. As the configurations of various barrels 23 vary, so do the configurations of recesses 36. In general, however, recess 36 is substantial semicylindrical.

Referring again to FIG. 3, it will be seen that forend 30 also is comprised of a recess 38 within which may be disposed frame 22, which is secured to forend 30 by conventional means (not shown).

Referring again to FIG. 3, it will be seen that forend 30 also is comprised of forend cap 40. This forend cap 40, and its associated structure, will be described in greater detail elsewhere in this specification.

Figure 10:
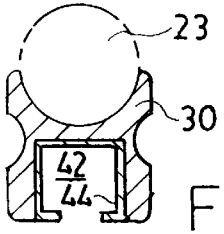
Figure 5:
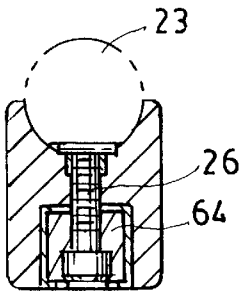

The forend 30 contains a recess 42 which, in the preferred embodiment depicted in the Figures, is defined by tubing 44 (see, e.g., FIG. 10). In another embodiment, not shown, forend 30 is formed from synthetic polymeric material, and the recess 42 contained therein is integrally formed within such synthetic polymeric material.

Referring again to FIG. 10, and in the preferred embodiment depicted therein, it will be seen that tubing 44 has a substantially square shape. In another embodiment, not shown, tubing 44 may have a substantially rectangular shape, a substantially circular shape, a substantially oval shape, etc.

It is preferred that tubing 44 be made from a material with different physical properties than that which the forend 30 is made from. In one embodiment, forend 30 is made from wood (such as, e.g. mahagony or other close grained wood), and tubing 44 is made from steel. Alternatively, tubing 44 may be made from aluminum, alloy materials, and the like.

In one embodiment, tubing 44 is made from cold rolled steel, has a square with exterior walls of about 0.625 inches length and height, and has a wall thickness about 0.06 inches.

The tubing 44 may be joined to the forend 30 by conventional means such as, e.g., fasteners, adhesives such as epoxy cement, etc.

Figure 8:
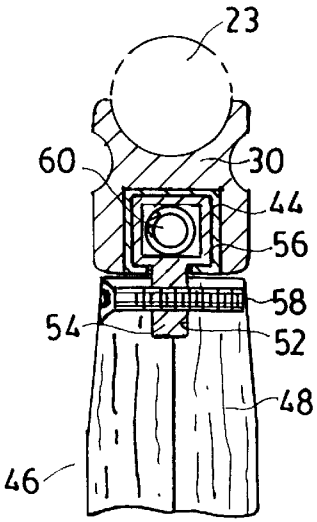
FIGS. 4 through 11 are sectional views of the forend assembly of FIG. 2, taken through lines 4—4, 5—5, 6—6, 7—7, 8—8, 9—9, 10—10, and 11—11, respectively, of FIG. 2.
Figure 7:
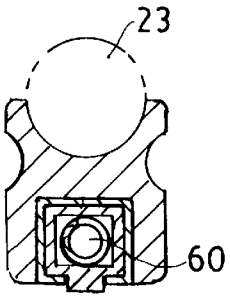
Figure 11:
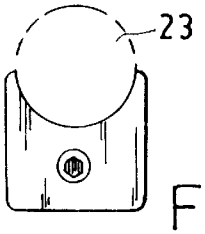
Figure 6:
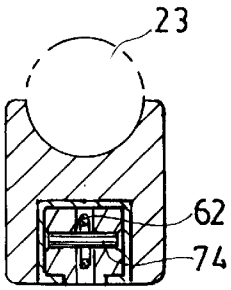

FIG. 8 illustrates how one preferred pistol grip assembly 46 is disposed within tubing 44. Referring to FIG. 8, it will be seen that pistol grip assembly 46 is comprised of pistol grip 48 which can be, but need not be, similar in configuration to pistol grip 50 (see FIG. 1).

Referring again to FIG. 8, and in the preferred embodiment depicted therein, it will be seen that pistol grip 48 is comprised of a slot 52 within which leg 54 of slider 56 is disposed. The leg 54 may be secured to pistol grip 48 by means of fastener 58. Alternatively, or additionally, one or more other fasteners and/or fastening means may be used.

Referring again to FIG. 8, and in the preferred embodiment depicted therein, it will be seen that slider 56 is comprised of an orifice 60 which extends substantially the entire length of slider 56.

Figure 13:
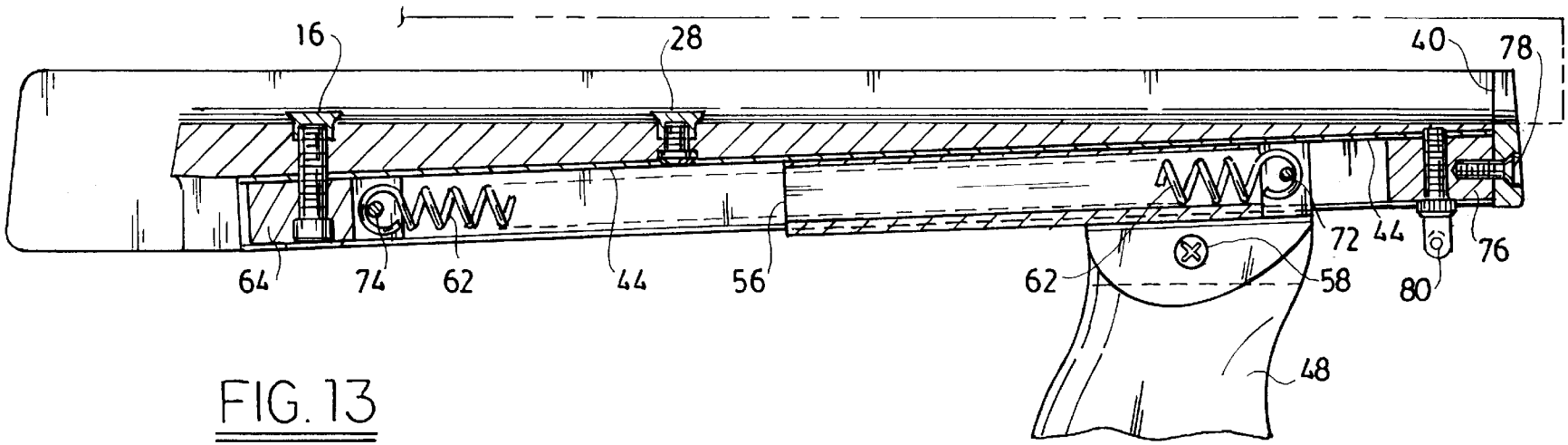
FIG. 13 is a sectional view illustrating how the spring assembly within the slide device moves upon experiencing the recoil force of firing.

FIG. 13, from which unnecessary detail has been omitted for the sake of simplicity of representation, also illustrates slider 56 and its operation. Referring to FIG. 13, it will be seen that slider 56 is attached by means of spring 62 to spring retainer 64. Referring to FIGS. 2 and 13, it will be seen that spring retainer 64 is attached by means of screw 26 to both barrel 23 and forend 30. As will be apparent to those skilled in the art, when recoil force is applied to gun assembly 20 in the direction opposite that of arrow 66 (see FIG. 22), the gun assembly 20 will tend to travel in such opposite direction. Inasmuch as as pistol grip 48 is held in a substantially fixed position, its relative position vis-a-vis gun assembly 20 will change from position 68 (shown in dotted line outline) to position 70. As will be apparent to those skilled in the art, the fact that spring 62 is fixedly attached to both spring retainer 64 and to slider 56 will tend to limit the movement of the gun assembly 20 vis-a-vis the pistol grip 48.

The spring 62 may be attached to the slider 56 by conventional means. In one embodiment, illustrated in FIG. 13, a pin 72 is used. A similar pin 74 may be used to attach the other end of spring 62 to the spring retainer 64.

Referring to FIG. 13, it will be seen that end cap 40 is attached to swivel retainer 76 by means of screw 78. The swivel retainer 76 is disposed within tubing 44 secured therein by means of swivel 80.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A forend assembly for cushioning the recoil force experienced when firing a firearm, wherein said forend assembly comprises a forend, means for securing said forend to a firearm barrel, a retainer fixedly disposed within said forend, and a pistol grip assembly slidably disposed within said forend, and wherein:

(a) said pistol grip assembly is comprised of a slide assembly, a pistol grip, and means for attaching said slide assembly to said pistol grip, wherein said slide assembly is attached to said retainer by means of a spring;

(b) said forend is comprised of a tube with a slot, wherein said tube is attached to said forend; and (c) each of said retainer and said slide assembly are disposed within said tube.

2. The forend assembly as recited in claim 1, wherein said forend assembly has a length of at least about 12 inches.

3. The forend assembly as recited in claim 1, wherein said forend assembly is connected to a firearm barrel.

4. The forend assembly as recited in claim 1, wherein said forend is comprised of a forend cap removably attached to said forend.

5. The forend assembly as recited in claim 1, wherein said forend is comprised of wood.

6. The forend assembly as recited in claim 1, wherein said forend is comprised of elastomeric material.

7. The forend assembly as recited in claim 1, wherein said forend is comprised of a recess adapted to receive said firearm barrel.

8. The forend assembly as recited in claim 7, wherein said recess has a substantially semicircular cross-sectional shape.

9. The forend assembly as recited in claim 1, wherein said tube with said slot has a substantially square cross-sectional shape.

10. The forend assembly as recited in claim 9, wherein said tube with said slot consists essentially of steel.

11. The forend assembly as recited in claim 1, wherein said slide assembly is comprised of a pistol grip.

12. The forend assembly as recited in claim 11, wherein said pistol grip is comprised of a slot.

13. The forend assembly as recited in claim 12, wherein said slide assembly is comprised of a slider.

14. The forend assembly as recited in claim 13, wherein said slider is comprised of a leg.

15. The forend assembly as recited in claim 14, wherein said leg is disposed within said slot of said pistol grip.

16. The forend assembly as recited in claim 15, wherein said leg is connected to said pistol grip by means of a fastener.

17. The forend assembly as recited in claim 16, wherein said slider is comprised of an orifice which extends substantially the entire length of said slider.

18. The forend assembly as rectied in claim 17, wherein at least a portion of said spring is disposed within said orifice which extends substantially the entire length of said slider.

* * * * *